US006568772B2

(12) United States Patent
Gerkey et al.

(10) Patent No.: US 6,568,772 B2
(45) Date of Patent: May 27, 2003

(54) ROTATABLE SHELF

(76) Inventors: Kenneth S. Gerkey, 186 Seminole Dr., Pittsburgh, PA (US) 15228; Ralph W. Kugler, 225 Roycroft Ave., Pittsburgh, PA (US) 15234

( * ) Notice: Subject to any disclaimer, the term of this patent is extended or adjusted under 35 U.S.C. 154(b) by 0 days.

(21) Appl. No.: 09/792,984

(22) Filed: Feb. 26, 2001

(65) Prior Publication Data

US 2002/0117943 A1 Aug. 29, 2002

(51) Int. Cl.[7] ..... A47B 97/00
(52) U.S. Cl. ..... 312/238; 312/307
(58) Field of Search ..... 312/238, 305, 312/125, 135, 307; 108/94, 104, 139

(56) References Cited

U.S. PATENT DOCUMENTS 4,124,262 A * 11/1978 Schill ..... 312/307 X
4,959,582 A * 9/1990 Meyer et al. ..... 312/307
5,152,592 A 10/1992 Krayer ..... 312/238

* cited by examiner

*Primary Examiner*—James O. Hansen
(74) *Attorney, Agent, or Firm*—William L. Krayer

(57) ABSTRACT

Substantially planar bearings are used for the support and rotation of a rotatable shelf in the shape of a Reuleaux triangle, which rotates eccentrically. The bearings may be separate from the rotation guidance system or may be an integral part of it.

10 Claims, 10 Drawing Sheets

PRIOR
ART

ROTATABLE SHELF

TECHNICAL FIELD

This invention relates to rotatable shelves, particularly for corner cabinets. The invention is an eccentric rotation and bearing system for a Reuleaux triangle type lazy susan especially useful in kitchen corner cabinets.

BACKGROUND OF THE INVENTION

This invention is an improvement on Krayer U.S. Pat. No. 5,152,592, which discloses the use of a hypocycloid rotation guide for rotating a shelf in the shape of a Reuleaux triangle. FIGS. 5A to 5H of the '592 patent illustrate that the rotation of a Reuleaux triangle-shaped shelf in a square area can be adapted to the standard area of a corner cabinet such as a corner kitchen cabinet in a generally square shape but having a 45° face. During the rotation, the shelf contacts all four sides of the square area at all times. The kinematics of such a rotation permits various types of guides such as are shown in FIGS. 6–13 and 17–19 of the U.S. Pat. No. 5,152,592. The entire U.S. Pat. No. 5,152,592 is incorporated herein by reference.

While the shelf disclosed by Krayer in U.S. Pat. No. 5,152,592 is appealing in many respects, it has been criticized for its vulnerability to tipping if a significant downward force is applied to a projecting apex. Also, the ball casters installed on the underside of the shelf, as in FIG. 6C, were expensive and their longevity was suspect.

Accordingly, a different application of the hypocycloid principle is needed in the art of rotatable shelves.

SUMMARY OF THE INVENTION

The present invention utilizes planar bearings rather than ball caster bearings. The planar bearings permit the convenient use of an antitipping flange. In a preferred embodiment, rotation of the shelf is guided by the use of vertical axis rollers applied to the vertical side surfaces in a hypocycloid track or groove. In another embodiment, the bottom of the track or groove has a low-friction planar surface, and feet or nubs projecting from the shelf for sliding in the groove have complementary low friction planar surfaces.

DETAILED DESCRIPTION OF THE INVENTION

Figure 1A:
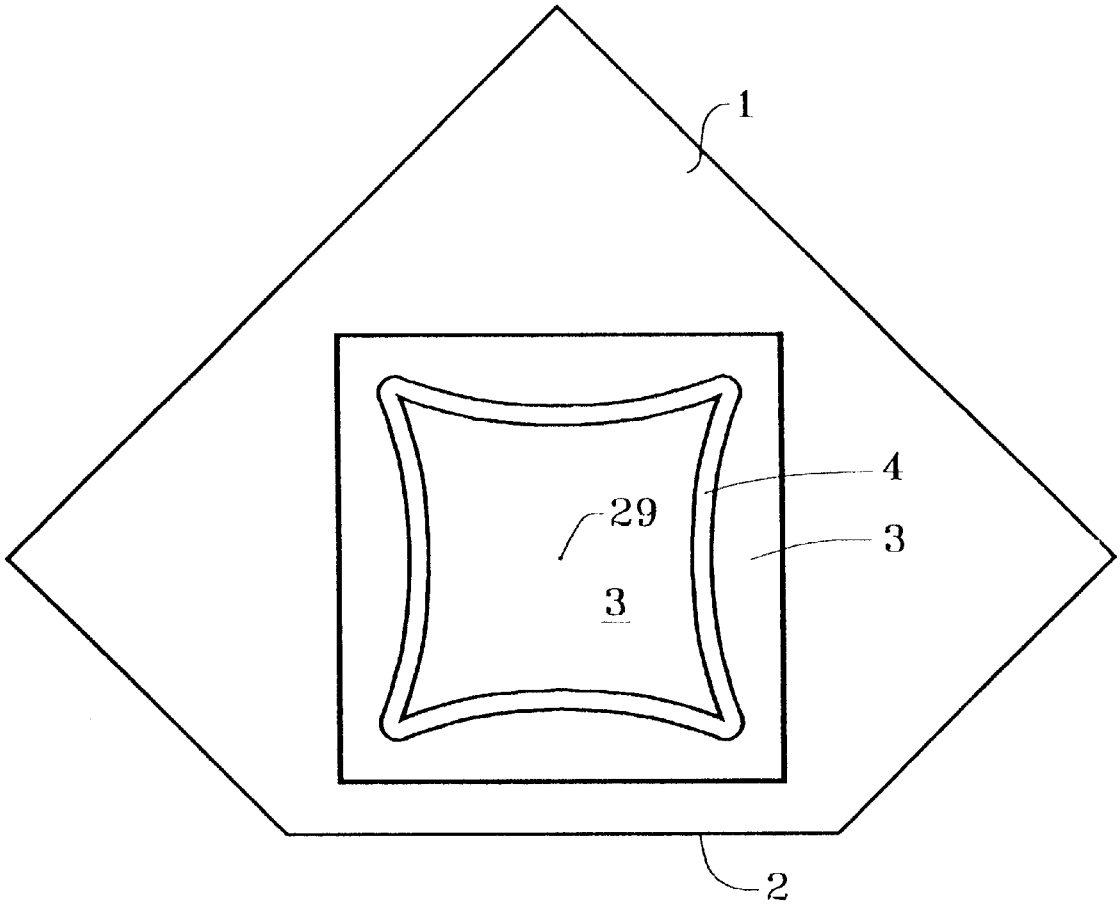
FIG. 1*a* shows the base of a standard kitchen corner cabinet equipped with a groove plate for guiding a prior art Reuleaux triangle shelf.

Referring to FIG. 1*a*, a prior art embodiment of a base hypocycloid guide is shown from an overhead perspective. The standard overhead corner kitchen cabinet base 1 is shown, having a door face front 2 for the corner cabinet door not shown. In this prior art device, a guide plate 3 is placed in the position shown on the cabinet base 1. The guide plate 3 has routed or molded into it a groove 4 of a shape determined by the hypocycloid function governing the rotation of a Reuleaux triangle shaped shelf as described in Krayer US Patent (see columns 5–8 in particular and the explanation elsewhere herein). Item 29 is the center of cabinet base 1—that is, the square whose corner is truncated to make door face front 2—and is also the center of the guide groove 4.

Figure 1B:
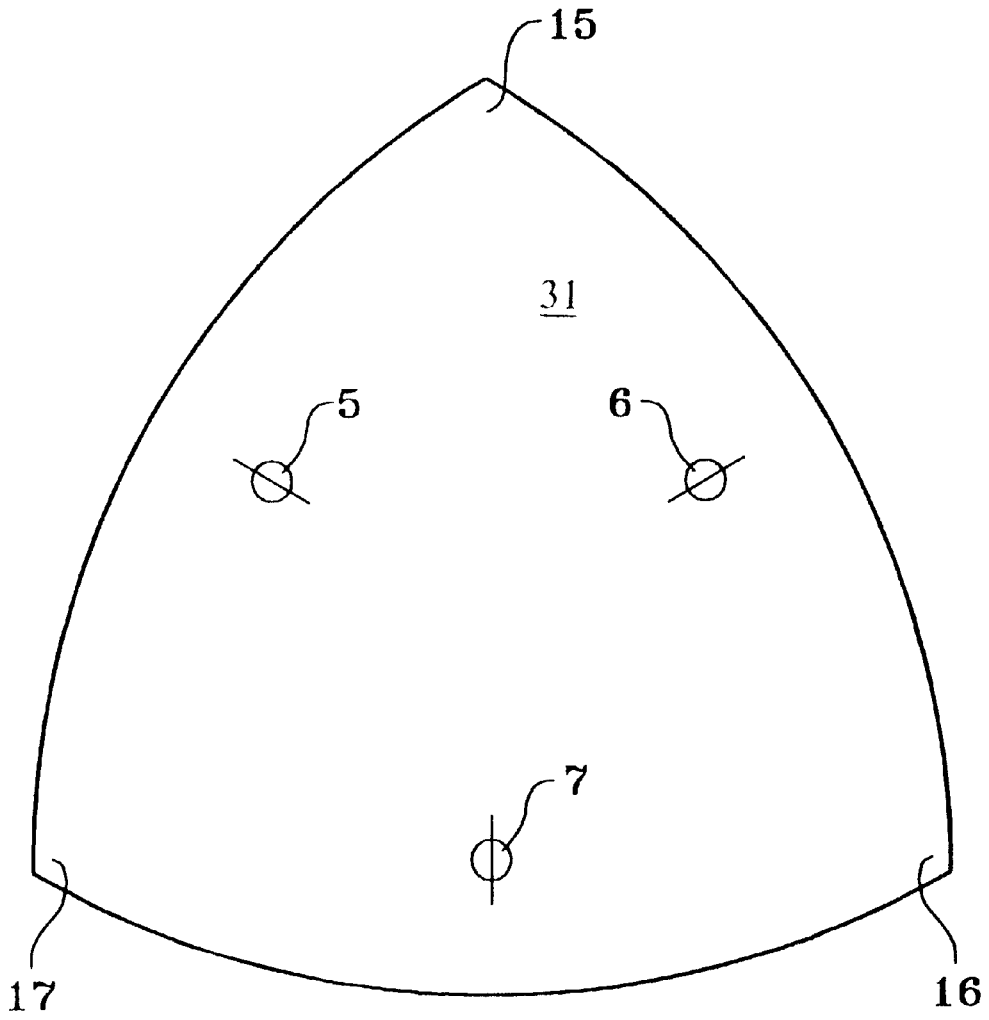
Fig. 1b PRIOR ART
FIG. 1*b* depicts the preferred shape of a shelf together with guide bearing locations for rotating in a base groove such as shown in FIG. 1*a*.

The Reuleaux triangle shape of the shelf 31 is shown in FIG. 1*b*, having apexes 15, 16, and 17. The Reuleaux triangle is a geometric shape of a class known as a curve of constant width; in this case the three sides of the shelf are equal arcs which can be inscribed from equal radii drawn from the apexes 15, 16, and 17. The points of apexes 15, 16, and 17 thus form the apexes of an equilateral triangle not shown. In FIG. 1*b*, bearing locations 5, 6, and 7 on the Reuleaux triangle-shaped shelf are related to the shape and location of guide groove 4 (FIG. 1*a*) as determined by the hypocycloid pattern generated by a computer as explained below and/or by any other means for tracing the paths of points on the shelf as it is turned in a square area. Note the concave square pattern of groove 4 accommodates bearing locations more toward the interior of the shelf than ball caster 61 in FIG. 6A of U.S. Pat. No. 5,152,592. In the prior art, ball casters are installed on the underside of the shelf at bearing locations 5, 6, and 7 to ride in the groove 4.

Figure 1C:
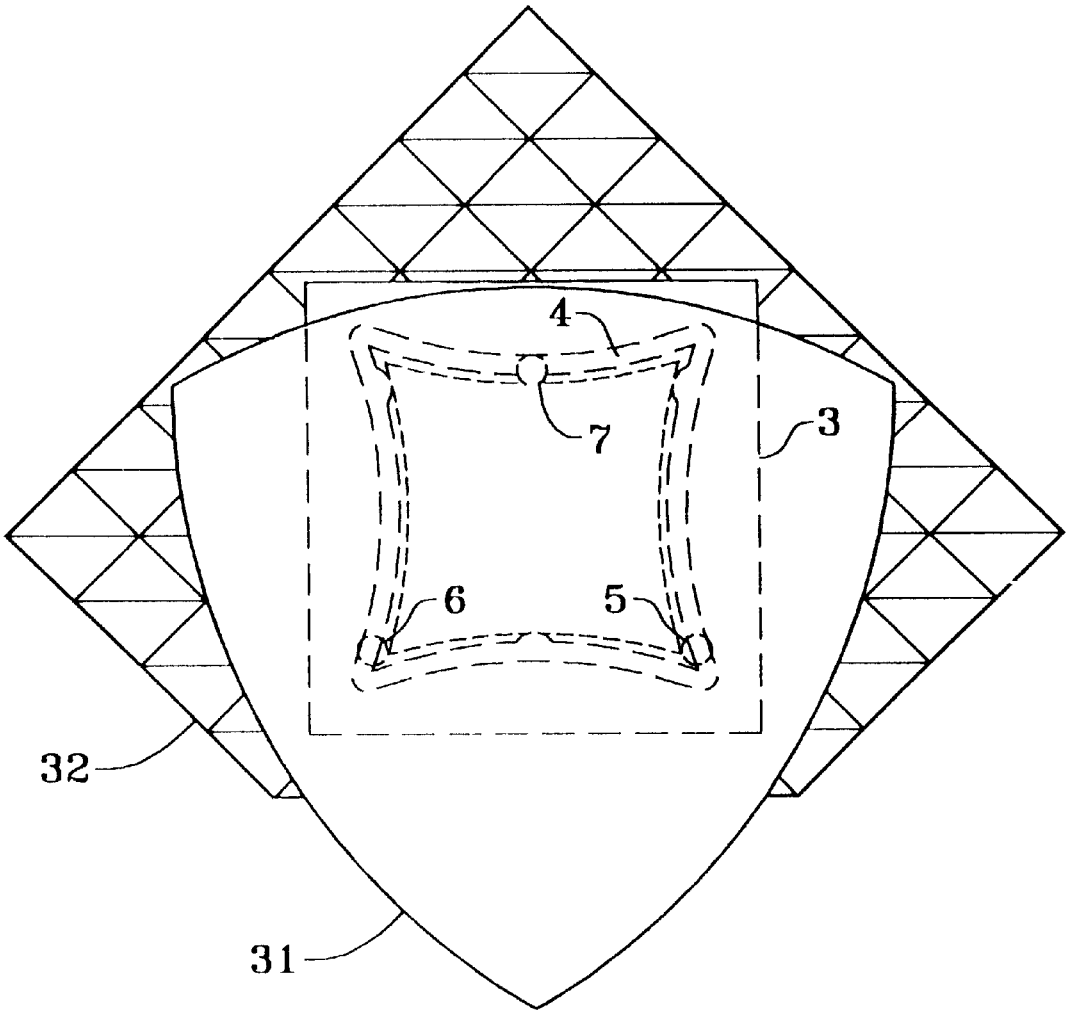
In FIG. 1*c*, a shelf of the present invention is installed on the base.

In FIG. 1*c*, placement is shown of shelf 31 on guide plate 3 and within the cabinet 32, which has a base such as base 1 in FIG. 1*a*. Unlike the prior art, we do not use ball casters to ride in groove 4 at bearing locations 5, 6, and 7; rather, we use cylindrical rollers on horizontal axes, or feet (hereinafter nubs) having planar low-friction bottom surfaces. The shelf 31 will turn eccentrically but smoothly (in a hypocycloid pattern) as described in Krayer U.S. Pat. No. 5,152,592 so that each side of the shelf contacts each side of a square at a single point.

Figure 1D:
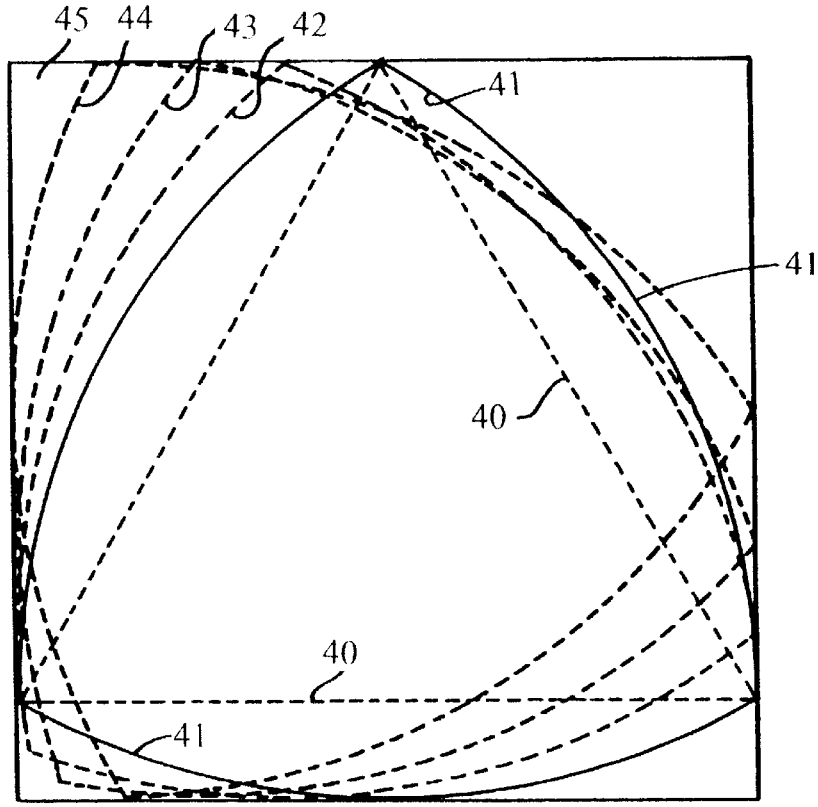
FIG. 1*d* illustrates the rotation of a Reuleaux triangle within a square area.

The rotation of the Reuleaux triangle-shaped shelf is shown in FIG. 1*d*. The equilateral triangle 40 is seen to provide the geometric basis for the construction of Reuleaux triangle 41. As the shelf is turned manually, it passes through positions 42, 43, and 44, at all times contacting all four sides of square 45.

Figure 1E:
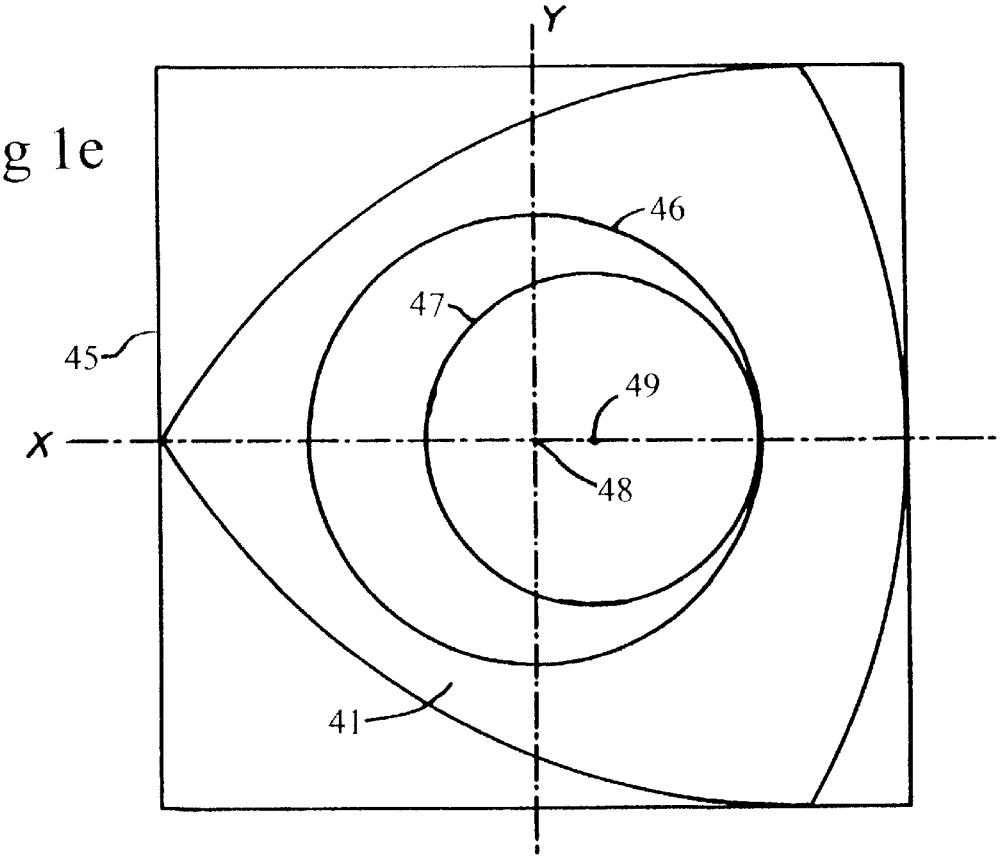
FIG. 1*e* depicts the "internal gear" aspect of the rotation, providing a convenient way to plot a guide groove.

The rotation of the Reuleaux triangle within a square is mathematically a function of the hypocycloid action of two circles having particular relationships to the square area and/or the width of the triangle. The width of the Reuleaux triangle is the same as the side dimension of the square area in which the Reuleaux triangle is to rotate. Referring now to FIG. 1*e*, the circles 46 and 47 have their centers, respectively, at the center of square 45 and Reuleaux triangle 41. They have a ratio of 4:3 and have diameters, respectively, 0.6184 and 0.4638 times the width of the Reuleaux triangle 41. Since the width of the Reuleaux triangle 41 is the same as the width of square 45, the diameters of circles 46 and 47 are also 0.6184 and 0.4638 times the width of the square. Such a square, i.e having the same width as the Reuleaux triangle, is the smallest square into which the Reuleaux triangle will fit. The centers 48 and 49 of circles 46 and 47 respectively being fixed at the centers of the square 45 and the Reuleaux triangle 41 (the center of the Reuleaux triangle being at the intersection of the bisectors of its corner angles), they are a distance apart 0.0773 times the width of the Reuleaux triangle. When the circle 47 is fixed to the Reuleaux triangle and rotated in a hypocycloid fashion with respect to stationary circle 46, i.e. "rolling" around and in contact with the inside of circle 46 as an internal gear system operates (see FIG. 8 of U.S. Pat. No. 5,152,592), all points of the Reuleaux triangle will be caused to move in predetermined patterns within the designated square area and may be plotted on X and Y axes. Since the points on the Reuleaux triangle are in predetermined relation to circle 47, which is fixed to it or drawn on it, all the points of the Reuleaux triangle will move in predetermined patterns within the square on in contact with its edges as circle 47 rolls around the inside of and in contact with circle 46 in a hypocycloid manner. One may select points on the triangle for the placement of bearings to be guided, rotate the Reuleaux triangle as described, and plot the points of a pathway for them. Thus the bearing locations 5, 6, and 7, located symmetrically on their triangle sides, will follow the concave square pattern of guide groove 4. Alternatively, one may plot a guide groove by computer using the known hypocycloid formula x=(a−b)*cos(theta)+b*cos(h*theta) and y=(a−b)*sin(theta)−b*sin(h*theta) where x and y are the coordinates of a point, a is the radius of the fixed circle, b is the radius of the rolling circle, h is (a−b)/b, and theta is the angle between the x axis and the line connecting the centers of the two circles. Here, a and b are in a fixed relationship, a 4:3 ratio, and have dimensions determined by the size of the Reuleaux triangle. The location of a point outside the circles at any time in the rotation may be determined as a function of h, i.e h+k. Such a program may be used also to generate a path for four bearing locations, one on each side of the square, rather than one on each side of the triangle, by assuming the circle 47 is fixed on the base and rotating circle 46 on it. In this case, where the guide locations are a small distance inside the sides of the square, the guideway will be seen to have a three-lobed, or cloverleaf, shape. This alternate construction may also be used.

Rotation of the shelf guided as suggested in the discussion above of FIGS. 1*a*–1*e* means that not only will the shelf turn in such a way as to be confined to a square area, but also that the apexes of the shelf will successively protrude from the door face front 2 (FIG. 1*a*). Thus the shelf is quite accessible, as its protruding apex means the center of the shelf has also moved outwardly; conversely, when the shelf is in the closed position (see FIG. 4*b*), a maximum percentage of the available area of cabinet base 1 is employed by shelf 31.

The present invention utilizes the hypocycloid rotation concept of the prior art, but employs a novel bearing and guiding combination.

Figure 2A:
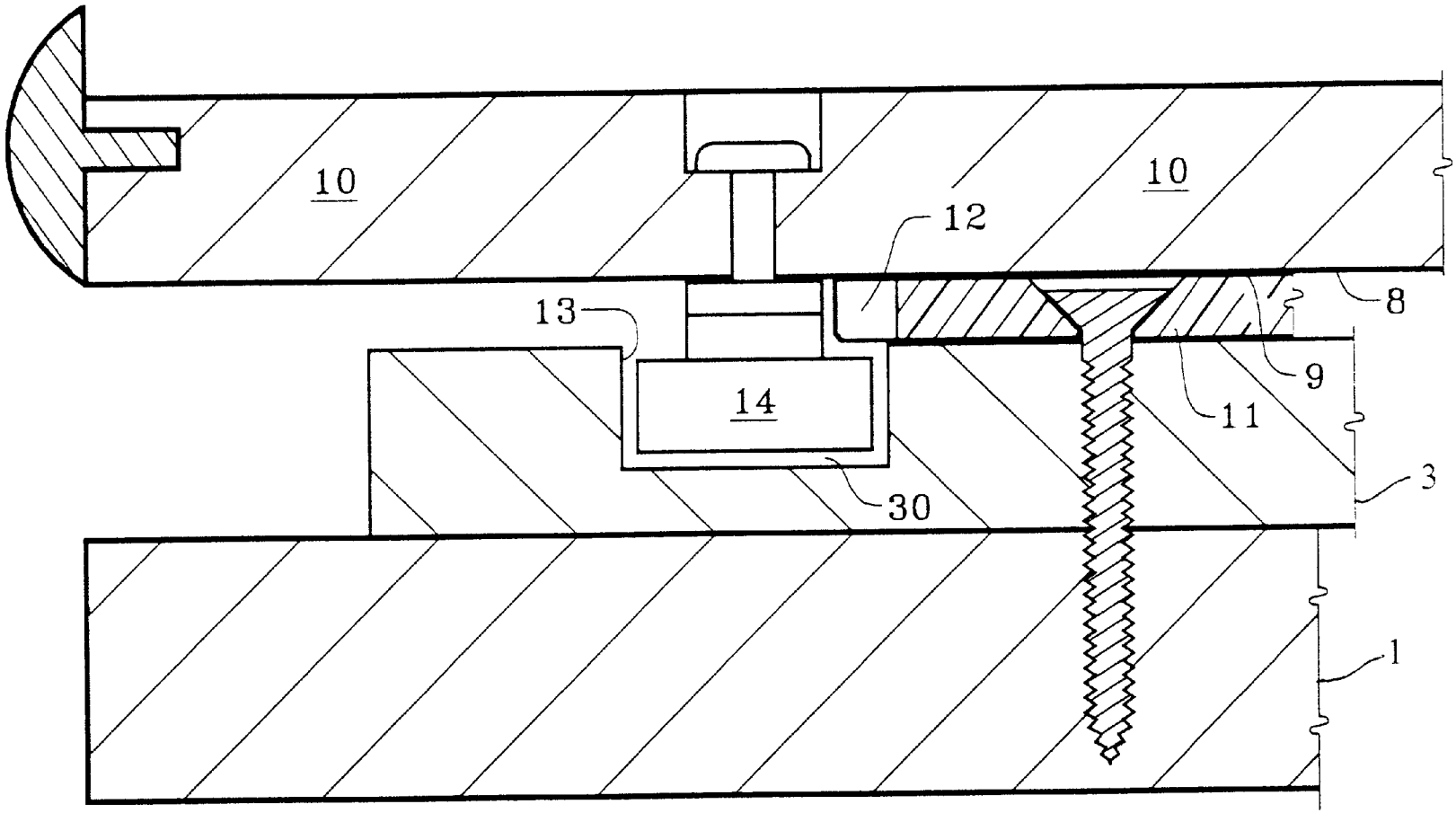
FIG. 2*a* is a sectional view showing a bearing and guide mechanism of the present invention.

In FIG. 2*a*, a vertical section is shown of guide groove 30 having a profile similar to that of groove 4 in FIGS. 1*a* and 1*c*. Contrary to the prior art, however, our invention does not use ball casters to support the shelf 10. Rather, we support shelf 10 by resting a substantially planar shelf bearing 8 on a base planar bearing plate 11 having a substantially planar bearing surface 9. Preferably both substantially shelf bearing 8 and bearing plate 11 are made of low-friction materials and bearing surface 9 is simply the top of the bearing plate 11. In FIG. 2*a*, the shelf planar bearing 8 is the underside of shelf 10, which may be made of any suitable substantially flat material, usually synthetic resin or wood; if it is wood, the wood is preferably smooth and covered with a durable coating. Base plate bearing 11 and its bearing surface 9 are also preferably made of synthetic resin sheet, such as high density polyethylene, but may be any low-friction material. Base plate bearing 11 may be constructed separately from base plate 3 or may be an integral part of base plate 3. Flange 12 may be attached to both.

Rotation of shelf 10 in the configuration of FIG. 2*a* is guided in guide groove 30 by three rollers 14, which may be placed on the shelf 10 at bearing locations 5, 6, and 7 as shown in FIG. 1*b*, or in other locations which may be selected in the process of designing a guide pathway as explained with reference to FIGS. 1*d* and 1*e*. Rollers 14 have vertical axes, so when the shelf is moved, they contact the vertical surfaces 13 of groove 30 to guide the rotation. Rollers 14 do not extend to the bottom surface of groove 30 and therefore do not act as load-carrying bearings. Rollers 14 may be conventional nylon cabinet drawer slide rollers.

Figure 2B:
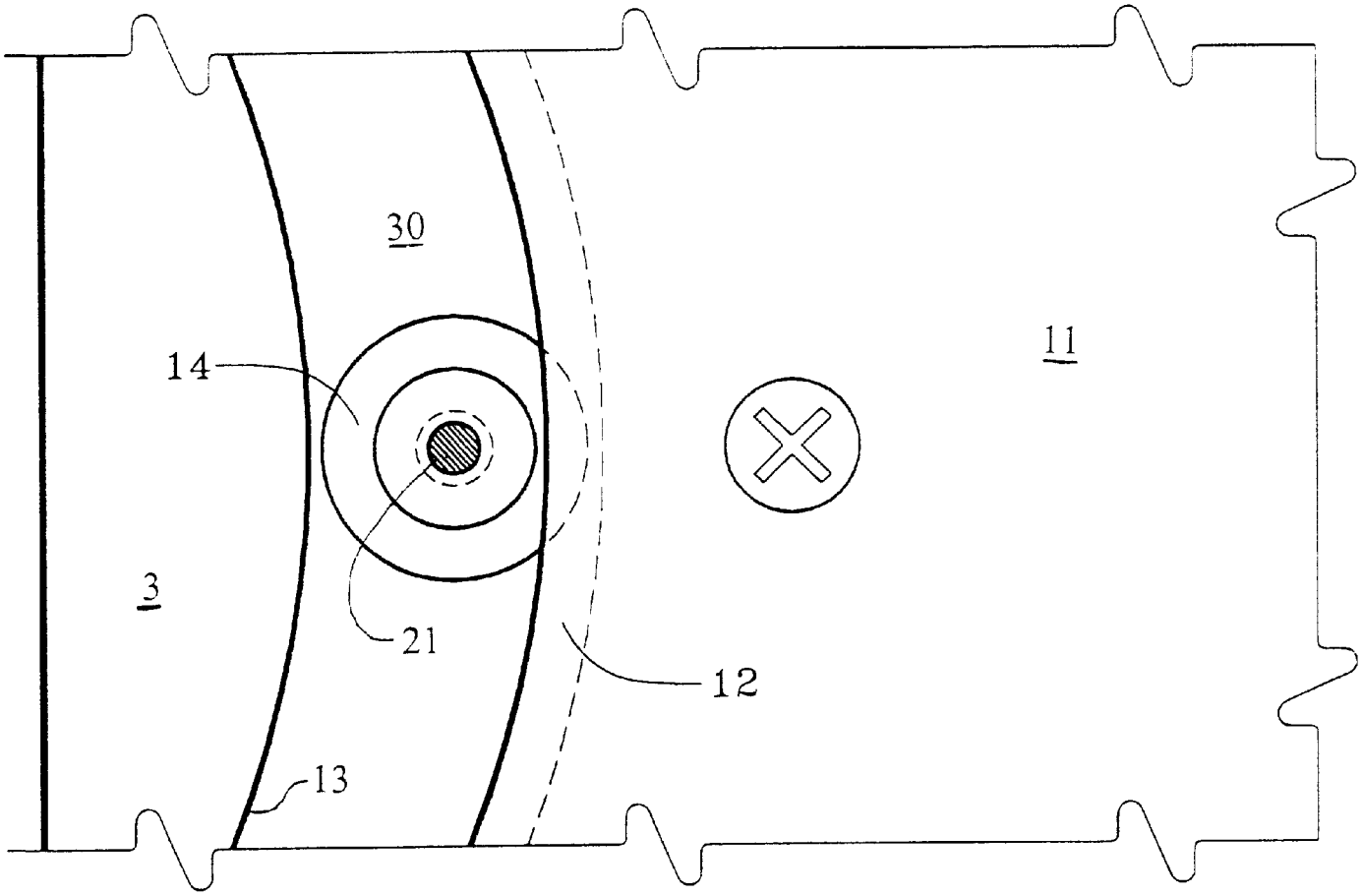
FIG. 2*b* is an overhead view of the same bearing and guide elements.

Flange 12 is seen in both FIGS. 2*a* and 2*b*. Flange 12 may be an integral part of base plate 3 and base plate bearing 11. Flange 12 extends over roller 14, confining roller 14 in groove 30 so that upward motion of roller 14 will be stopped. The clearance between the upper surface of flange 12 is discretionary, but generally should not be so little that contact is made between roller 14 and flange 12 during normal rotation, and should not be so great that it will cause objects on the shelf to shift if somehow the shelf tends to move upwardly.

FIG. 2*b* shows an overhead view of base plate 3. Groove 30 is cut, molded or otherwise built into base plate 3, and roller 14, turning on vertical axis 21 moves in groove 30, being retained therein by flange 12.

Figure 3A:
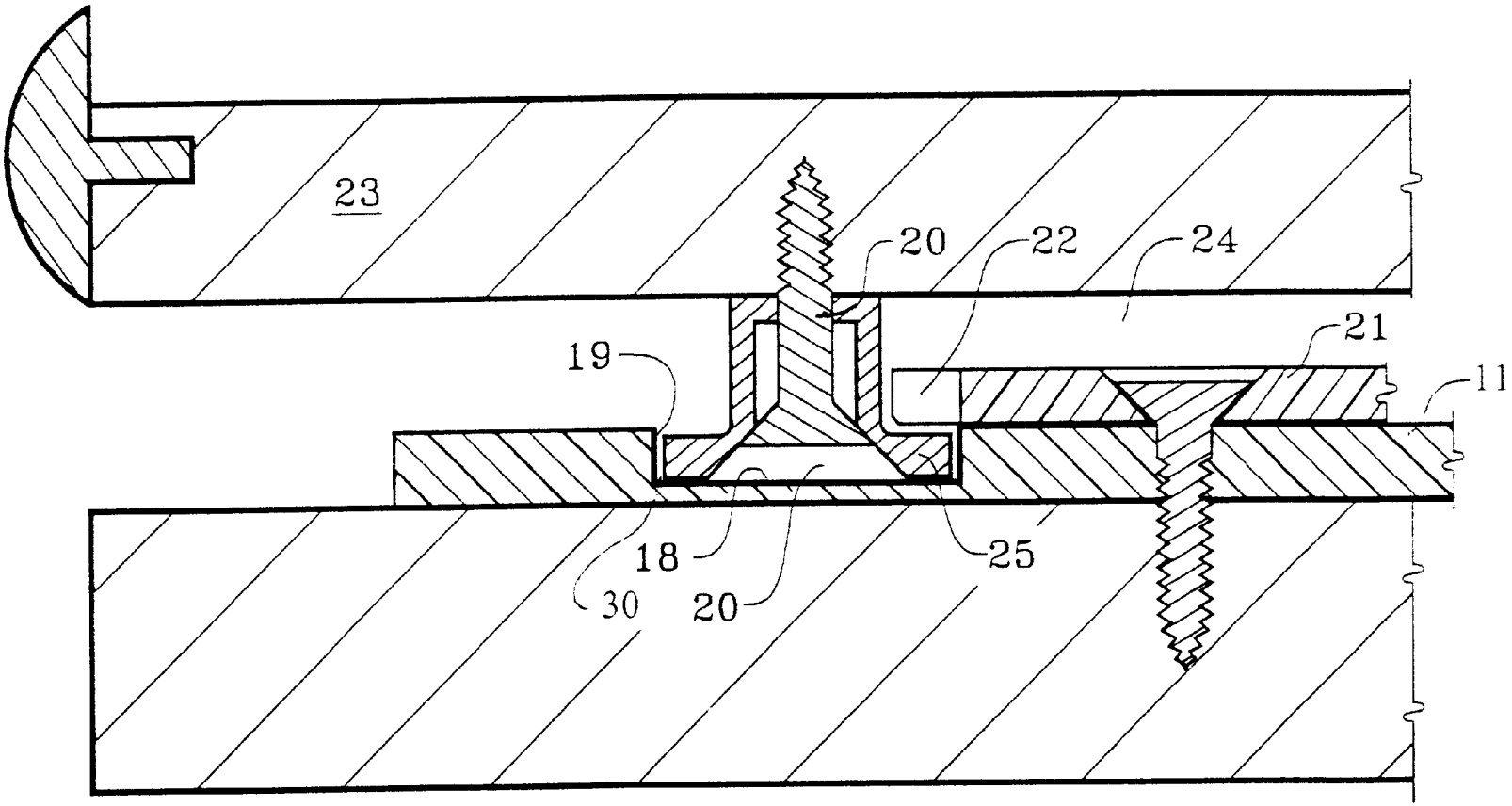
FIGS. 3*a* and 3*b* are sectional and overhead views of an alternate embodiment of the bearing and guide elements of our invention.

In FIG. 3*a*, a variation of our invention is shown in which the planar bearings are located in groove 30. The bottom surface 18 of groove 30 is substantially planar, complementing the bottom surface of nub guide 25, held on shelf 23 by screw 20. Substantially planar bottom surface of nub guide 25 and substantially planar surface 18 of groove 30 are preferably both of low-friction materials.

Still viewing FIG. 3*a*, the rotation of shelf 23 is guided by the design configuration of groove 30. Here it is also beneficial if the vertical walls of groove 30, such as wall 19, are of a low friction material, since the nub 25 will rub against the vertical walls 19 of groove 30 as the shelf is guided in its rotation. In FIG. 3*a*, there is clearance 24 between shelf 23 and flange plate 21, resting on base bearing plate 11. Again, base bearing plate 11, flange plate 21 and flange 22 need not be separate parts but could be a single monolithic unit. As with the version of FIG. 2*a*, flange 22 is positioned to prevent shelf tipping by preventing excessive upward motion of nub 25.

Figure 3B:
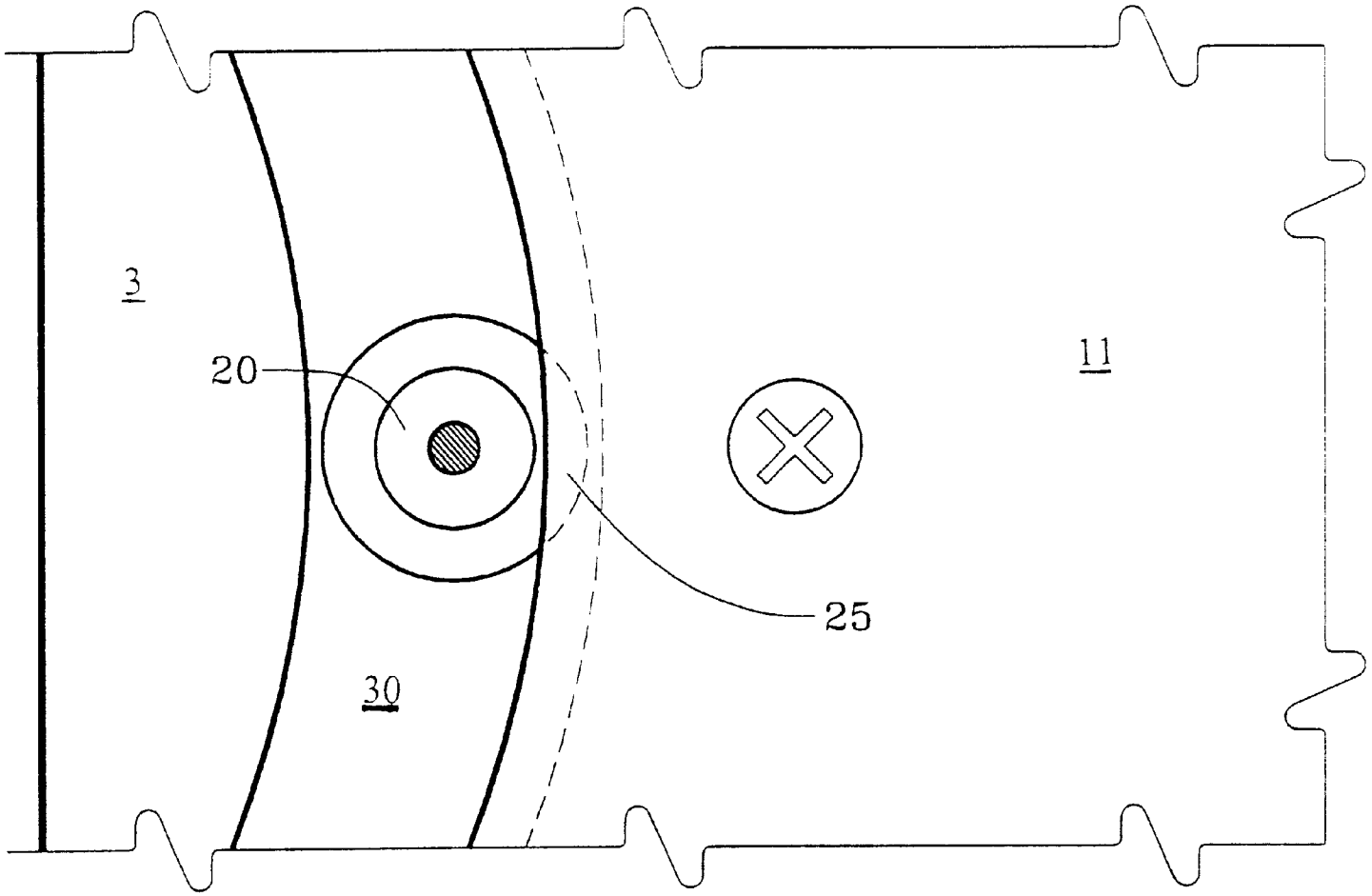

FIG. 3*b* is an overhead view of the version of FIG. 3*a*. Unlike the version of FIGS. 2*a* and 2*b*, in which rollers 14 are used, here the nub 25 is held in place by screw 20 and need not rotate in groove 30; rather, nub 25 glides in groove 30, by virtue of its substantially planar bottom surface, on the substantially planar bottom surface of groove 30.

Figure 4A:
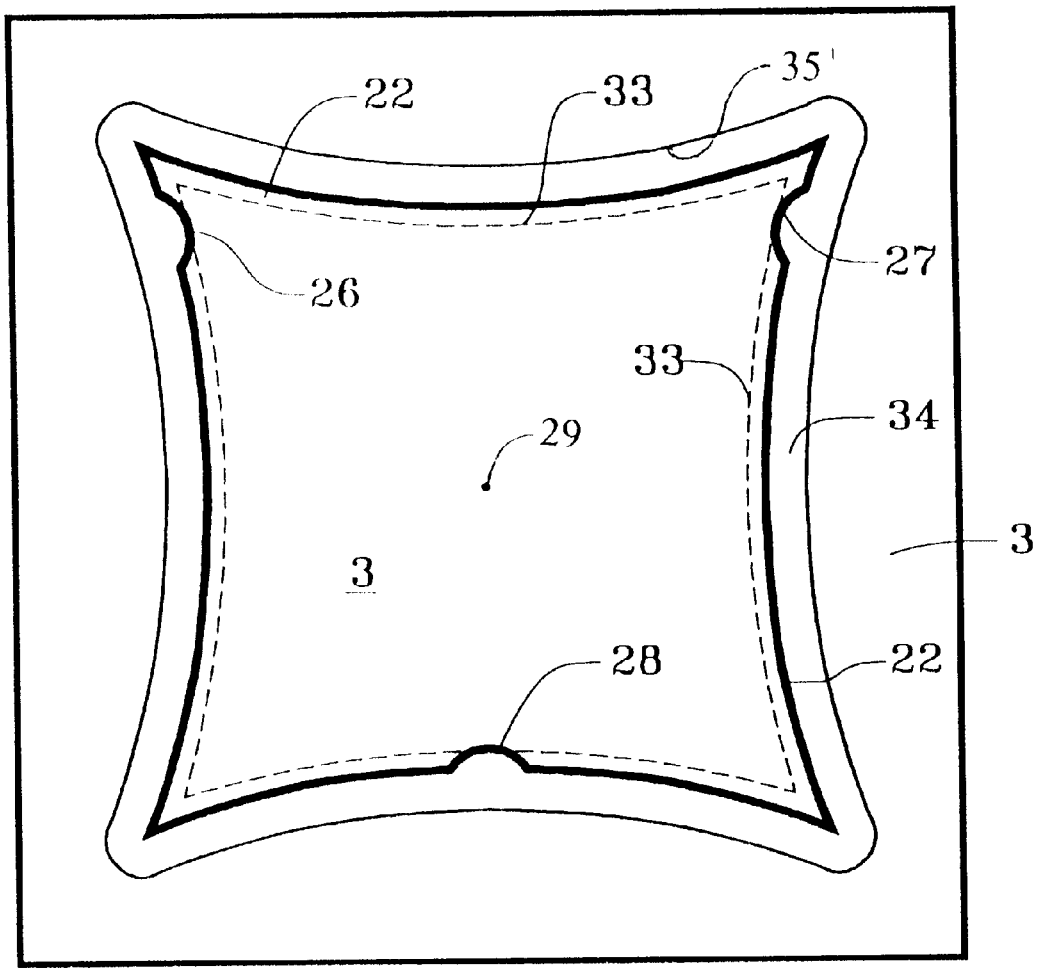
FIG. 4*a* shows a base guide of the present invention.

In FIG. 4*a*, a preferred construction of base plate 3 is seen in some detail. Groove 34 is cut into the base plate 3 in a pattern similar to but possibly somewhat different from that of groove 4 in FIG. 1*a*, at the discretion of the designer (see the discussion of FIGS. 1*a*–1*e*). Groove 34 has an inner edge 33 and an outer edge 35 both of which are vertical surfaces.

Base plate 3 is a substantially flat surface extending flange 22 over the inner edge 33 of groove 34. Indentations 26, 27, and 28 should be dimensioned to permit insertion of the rollers 14 or nubs 25 conveniently and to effect proper placement of the shelf—so that it will turn manually as soon as the rollers or nubs are engaged and so the shelf may be removed readily for cleaning. Depending on dimensions of the flange 22 and rollers 14 or nubs 25, only one of the indentations 26, 27, or 28 may be needed to insert and remove the rollers from under the flange 22. The base plate 3 should be fastened to cabinet base 32 (see FIG. 4*b*) prior to installation of the shelf.

Figure 4B:
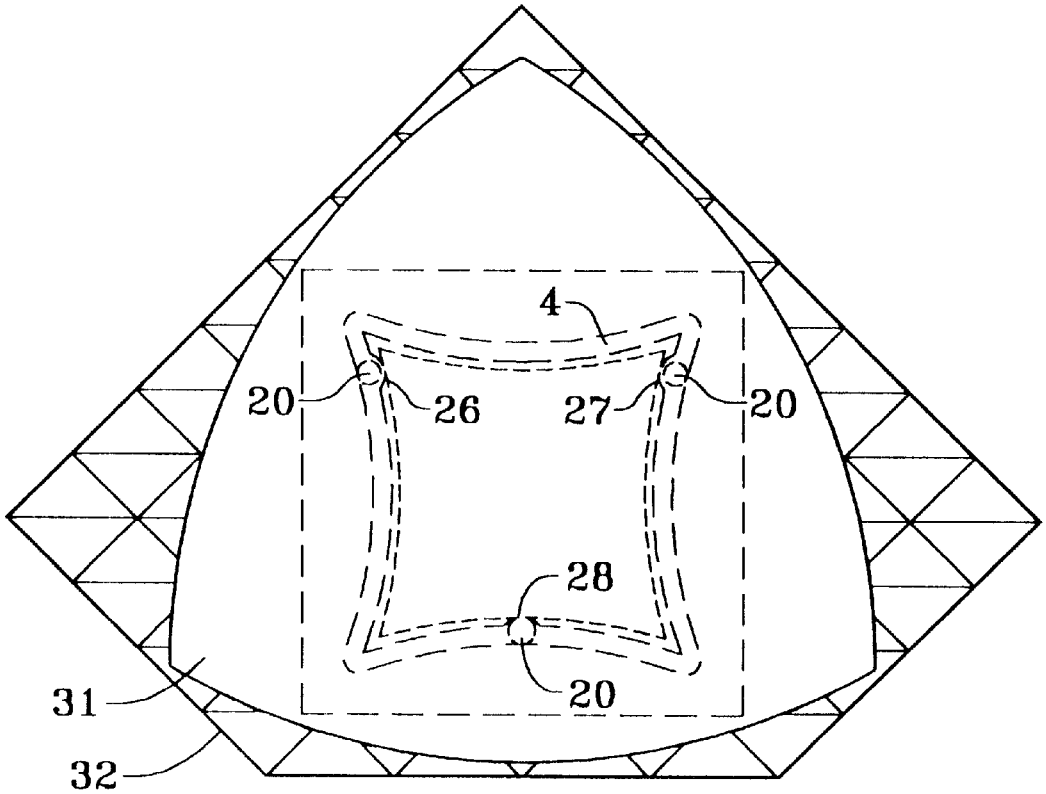
FIG. 4*b* illustrates placement of the shelf on the base for installation and removal.

Placement of the shelf 31 is shown in FIG. 4*b*. Here, rollers 14 or nubs 25 as previously described are inserted at indentations 26, 27, and 28 of flange 22 (see also FIG. 4*a*). In the illustrated orientation of shelf 31, the cabinet door may be closed, but as the shelf is rotated, for example to a position as in FIG. 1*c*, the door must be open.

Thus it is seen that our invention comprises a rotatable shelf in the shape of a Reuleaux triangle including substantially planar bearings. Our invention includes a rotatable shelf comprising a shelf body in the shape of a Reuleaux triangle and including substantially planar shelf bearing means thereunder, a base including substantially planar base bearing means complementary to said shelf bearing means, and guide means for guiding said shelf in a hypocycloid rotation. Our invention also includes apparatus for guiding and supporting the manual rotation of a Reuleaux triangle-shaped shelf comprising substantially planar bearings and a hypocycloid rotation guide.

What is claimed is:

1. Rotatable shelf apparatus comprising (a) a base including a substantially planar base bearing, (b) a shelf in the shape of a Rouleaux triangle including a substantially planar shelf bearing thereunder, (c) a guide for guiding said shelf in a hypocycloid rotation, said guide comprising (i) a groove on either said base or said shelf, and (ii) vertical axis rollers on the other of said base or said shelf, said vertical axis rollers placed in said groove but not extending to the bottom surface of said groove so as to act as load-carrying bearings, and (d) an antitipping flange extending over said groove to retain said rollers therein, said substantially self bearing resting on said substantially planar base bearing.

2. Rotatable shelf apparatus of claim 1 wherein said substantially planar shelf bearing comprises low-friction synthetic polymer.

3. Rotatable shelf apparatus of claim 1 wherein said substantially planar base bearing comprises low-friction synthetic polymer.

4. Rotatable shelf apparatus of claim 1 wherein said groove has substantially vertical walls.

5. Rotatable shelf apparatus of claim 1 wherein said groove is on said base and said vertical axis rollers are on said shelf.

6. Rotatable shelf apparatus of claim 5 having three vertical axis rollers.

7. Rotatable shelf apparatus comprising (a) a base including a substantially planar base bearing, (b) a shelf in the shape of Reuleaux triangle including a substantially planar shelf bearing thereunder, (c) a guide for guiding said shelf in a hypocycloid rotation, said guide comprising (i) a groove on either said base or said shelf, and (ii) nubs on the other of said base or said shelf, said nubs placed in said groove but not extending to the bottom surface of said groove so as to act as load-carrying bearings, and (d) an antitipping flange extending over said groove to retain said nubs therein, said substantially planar shelf bearing resting on said substantially planar base bearing.

8. Rotatable shelf apparatus of claim 7 wherein at least one of said shelf bearing and said base bearing comprises synthetic polymer.

9. Rotatable shelf apparatus of claim 7 wherein said groove is on said base and said nubs are on said shelf.

10. Rotatable shelf apparatus of claim 9 having three nubs.

* * * * *

UNITED STATES PATENT AND TRADEMARK OFFICE

CERTIFICATE OF CORRECTION

PATENT NO. : 6,568,772 B2 
DATED : May 27, 2003
INVENTOR(S) : Kenneth S. Gerkey and Ralph W. Kugler It is certified that error appears in the above-identified patent and that said Letters Patent is hereby corrected as shown below:

Column 3,
Line 65, insert -- planar -- between “substantially” and “shelf”

Column 6,
Line 3, delete “self” and substitute -- planar shelf --

Signed and Sealed this

Fifteenth Day of July, 2003

JAMES E. ROGAN
*Director of the United States Patent and Trademark Office*